US005986517A

United States Patent [19]

Kobayashi et al.

[11] Patent Number: 5,986,517

[45] Date of Patent: Nov. 16, 1999

[54] LOW-LOSS AIR SUSPENDED RADIALLY COMBINED PATCH FOR N-WAY RF SWITCH

[75] Inventors: Kevin W. Kobayashi; Aaron K. Oki, both of Torrance, Calif.

[73] Assignee: TRW Inc., Redondo Beach, Calif.

[21] Appl. No.: 09/003,197

[22] Filed: Jan. 6, 1998

[51] Int. Cl.[6] ..... H01P 1/15

[52] U.S. Cl. ..... 333/104; 333/262

[58] Field of Search ..... 333/104, 128, 333/262

[56] References Cited

U.S. PATENT DOCUMENTS

| | | | |
|---|---|---|---|
| 3,223,947 | 12/1965 | Clar | 333/104 |
| 3,597,706 | 8/1971 | Kibler | 333/104 |
| 4,127,830 | 11/1978 | Chalifour et al. | 333/104 |
| 4,302,734 | 11/1981 | Stockton et al. | 333/104 |
| 4,525,689 | 6/1985 | Wagner et al. | 333/104 |

OTHER PUBLICATIONS

"Micromachined Coplanar Waveguides in CMOS Technology" by V. Milanovic, M. Gaitan, E. Bowan and M. Zaghloul, iie. *Microwave and Guided Wave Letters,* vol. 6, No. 10, Oct. 1996, pp. 380–382.

*Primary Examiner*—Paul Gensler
*Attorney, Agent, or Firm*—Michael S. Yatsko

[57] ABSTRACT

A microstrip switch includes N-input switch arms and an output port formed from a microstrip transmission line. Each input switch arm includes one or more p-i-n diodes. The input switch arms as well as the output port are connected at a radially combined center patch. In order to improve the insertion losses at millimeter wave frequencies, the center patch is air suspended in order to reduce the parasitic shunt capacitance in order to extend the low pass frequency response of the switch.

6 Claims, 10 Drawing Sheets

LOW-LOSS AIR SUSPENDED RADIALLY COMBINED PATCH FOR N-WAY RF SWITCH

BACKGROUND OF THE INVENTION

1. Field of the Invention

The present invention relates to a microstrip switch for use in RF switch applications and more particularly to a broadband radially combined single pole N-throw microstrip switch with an improved insertion loss characteristic at millimeter wave frequencies, formed with a low loss air suspended radially combined patch which reduces the parasitic shunt capacitance and thus extends the low-pass response of the device.

2. Description of the Prior Art

Microstrip switches are used in various RF applications. Various configurations for such microstrip switches are known. For example, cascaded switches and orthogonal arms switch configurations are known. Radial combined switches are also known which offer symmetrical switch arm performance and the consolidation of multiple switch arms in a relatively small area compared to cascaded switches and orthogonal arm switches. The relatively small size of radially combined switches is especially attractive for low cost, high volume applications, such as automotive radar.

There is a limit to the bandwidth and low insertion loss which can be achieved by a radially combined microstrip switch. More particularly, two fundamental performance limitations exist at high frequencies: the cutoff frequency performance of the semiconductor switch; and the effective low pass characteristics of the microstrip radially combined microstrip switch. Both of these factors degrade the performance of the radially combined microstrip switch to a greater extend as the number of switch arms is increased.

An exemplary N-way radially combined single pole N-throw microstrip switch, generally identified with the reference numeral 20, is illustrated in FIG. 1. As shown, the microstrip switch 20 includes N input switch arms, identified in FIG. 1 with the reference numerals 22–36, and an output switch arm 38. The input switch arms 22–36 and the output switch arm 38 are connected at a radial combined patch 40. Each input switch arm 22–36 includes a pair of serially coupled p-i-n diodes 40 and 42, connected between an input microstrip transmission line 44, which acts as an input port, and an interconnecting microstrip transmission line 46 for each of the input switch arms 22–36. The interconnecting microstrip transmission lines 46 for each of the input switch arms 22–36 are coupled together at the radially combined patch 40. A microstrip transmission line 48 is connected to the radial combined patch 40 to provide an output port for the switch. The input and output microstrip 44 and 48 are illustrated as being 50 Ω.

Given the specific p-i-n diode process technology, the effect of gain-bandwidth or low loss bandwidth tradeoff of the microstrip switch 20 is adjusted by either scaling the size of the p-i-n diodes 40, 42 or by adding multiple p-i-n diodes in series, parallel or combinations thereof for each of the input switch arms 22–36. For high frequency operation, the p-i-n diodes 40,42 for each of the input switch arms 22–36 is configured such that the low pass cutoff frequency of the diodes 40,42 is beyond the operating frequency of interest.

FIGS. 2*b* and 2*c* represent the equivalent circuit models of a typical 2-$\mu$m i-region GaAs p-i-n diode with a cutoff frequency with $f_c$>2 THz for a p-i-n diode of a particular size as illustrated in FIG. 2*a*. As shown in FIG. 2*c*, the series off capacitance is relatively substantial. In order to reduce series off capacitance, two p-i-n diodes in series may be utilized in order to extend the bandwidth response at the expense of insertion loss. Because of the use of 2-$\mu$m GaAs p-i-n diodes with cutoff frequencies $f_c$>2 Thz and the relatively small size of the p-i-n diodes, the individual input switch arms 22–36 of the radially combined microstrip switch 20 will have a frequency response beyond the frequency of interest. It is the low pass roll-characteristic of the radially combined microstrip switch which will be the limiting performance factor for an N-way microstrip switch at millimeter-wave frequencies.

In general, for a large number of radially combined input switch arms 22–36, the radially combined patch 40 will be of significant area and will contribute to the dominant low-pass loss characteristics of the N-way switch 20 at millimeter-wave frequencies. By reducing the size of the radial combined patch 40, the associated parasitic impedances can be minimized and the frequency response extended. However, the width of the output 50 Ω microstrip transmission line 38, for example 70 $\mu$m for a 4 mil GaAs substrate, will ultimately limit how small the radial combined patch 40 can be made as generally illustrated in FIG. 9.

FIG. 3 illustrates a lumped element equivalent circuit of the single pole N-throw radial combined microstrip switch 20 illustrated in FIG. 1. As shown, the radially combined patch 40 can be represented by a L-C low pass network 41. When the Nth input switch arm 36 is switched on and all of the other N−1 inputs switch arms 22–34 are switched off, the thru-path of the Nth input switch arm 36 can be represented by the equivalent circuit illustrated in FIG. 4. As shown in FIG. 4, the low pass response of the microstrip switch 20 can be characterized by a simple low pass filter network formed from a series inductance $L_{feed}$ and the effective parallel combination of the shunt capacitors $C_{off}$ (N−1)/2 and $C_{feed}$. For very high performance Schottky p-i-n diodes with cutoff frequencies $f_c$>2 THz, the shunt capacitant $C_{feed}$ can typically account for ≧15% of the total effective shunt capacitance. When the radially combined patch 40 is large in diameter to accommodate a typical wide 50 Ω fixed output microstrip transmission line 38, the shunt capacitance $C_{feed}$ is large and the associated series inductance $L_{feed}$ is small. If the electrical and physical restraints allow the reduction of the diameter of the radially combined patch 40, the shunt capacitance of the radially combined patch 40 will become relatively smaller; however, the input microstrip transmission lines 44 will become more inductive. Thus, there is only a marginal benefit gained by changing the size in geometry of the radially combined patch, since the low pass pole, determined by series inductance $L_{feed}$ and shunt capacitance $C_{feed}$, will not significantly change. Thus, enhanced frequency performance of a radially combined microstrip switch has not heretofore been known to be obtained by simply changing the size of the radially combined patch.

SUMMARY OF THE INVENTION

It is an object of the present invention to solve various problems in the prior art.

It is yet another object of the present invention to provide a radially combined single pole N-throw microstrip switch with improved performance.

It is yet another object of the present invention to provide a radially combined single pole N-throw microstrip switch with improved insertion losses at millimeter wave frequencies.

Briefly the present invention relates to a microstrip switch which includes N-input switch arms and an output port, formed from a microstrip transmission line. Each input switch arm includes one or more p-i-n diodes. The input switch arms as well as the output port are connected at a radially combined patch. In order to improve the insertion losses at millimeter wave frequencies, the radially combined patch is air suspended in order to reduce the parasitic shunt capacitance in order to extend the low pass frequency response of the switch.

DESCRIPTION OF THE DRAWINGS

These and other objects of the present invention will be readily understood with reference to the following specification and attached drawing wherein.

DETAILED DESCRIPTION

The present invention relates to a radially combined microstrip switch with reduced insertion loss characteristic at millimeter wave frequencies. For a given radial combined patch size, determined by the number of input arms as well as the physical and electrical constraints of the design, the stray shunt capacitances of the switch are reduced by removing the high dielectric material beneath the radial combined center patch in accordance with the present invention. In the case of microstrip switches formed from type III-V semiconductor compounds, such as GaAs, the shunt capacitance can be reduced by an order of magnitude.

Figure 1:
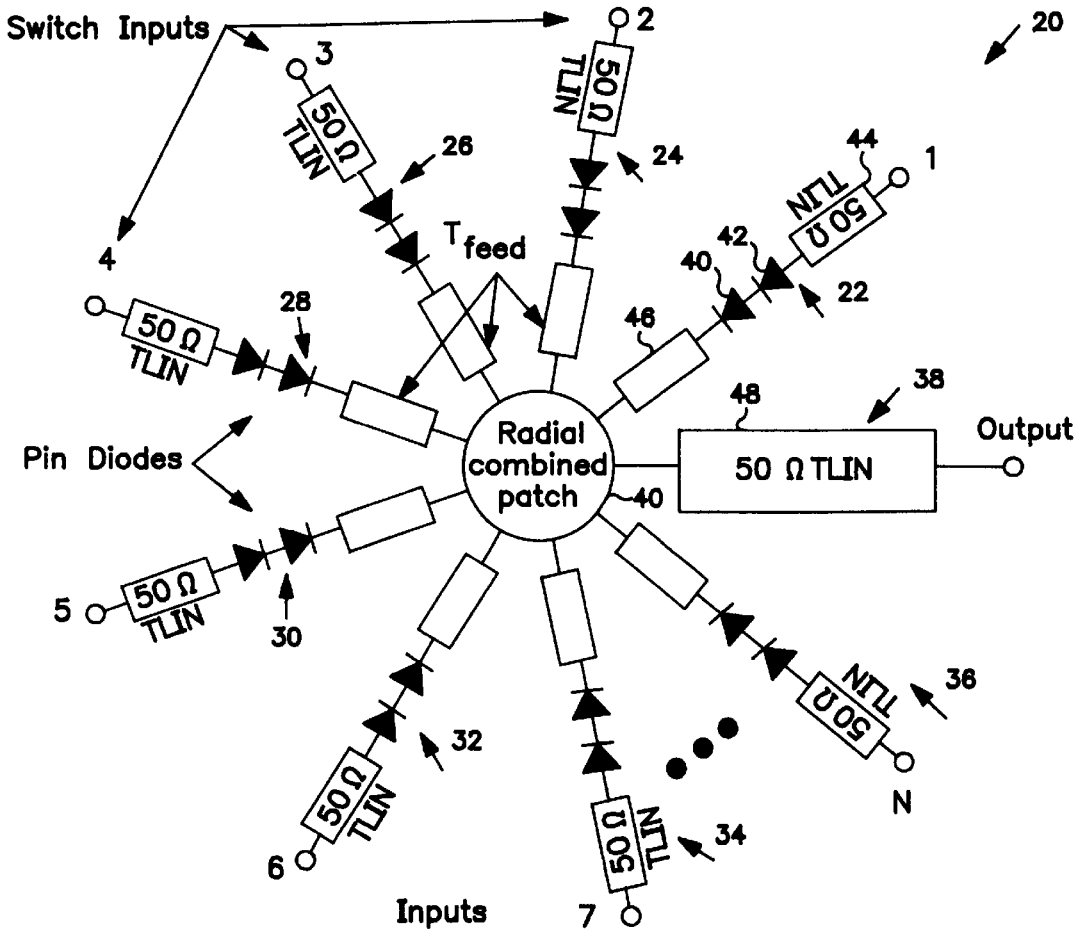
FIG. 1 PRIOR ART
FIG. 1 is a schematic diagram of a N-way radially combined microstrip switch.
Figure 2C:
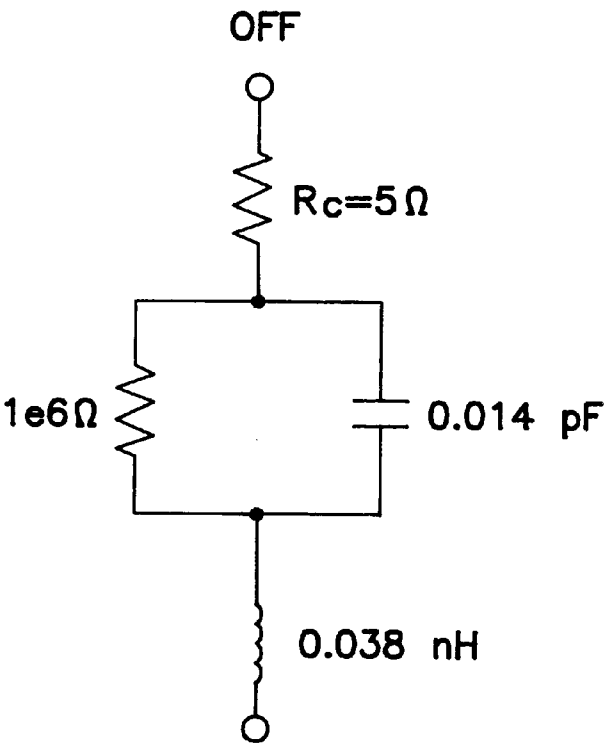
FIGS. 2*b*–2*c* illustrate the equivalent to 2-$\mu$ i-region GaAs p-i-n diode with a cutoff frequency $f_c$>2 Thz in both the on state and off state, respectively, for a particular sized diode illustrated in FIG. 2*a*.
Figure 2B:
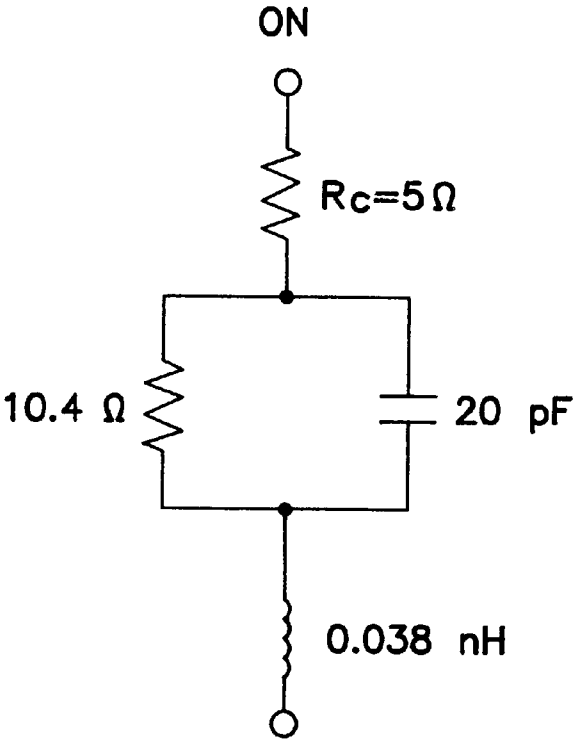
Figure 2A:
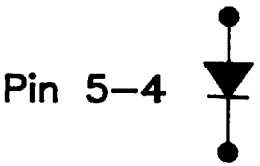
FIG. 2*a* is a schematic representation of a p-i-n diode.
Figure 3:
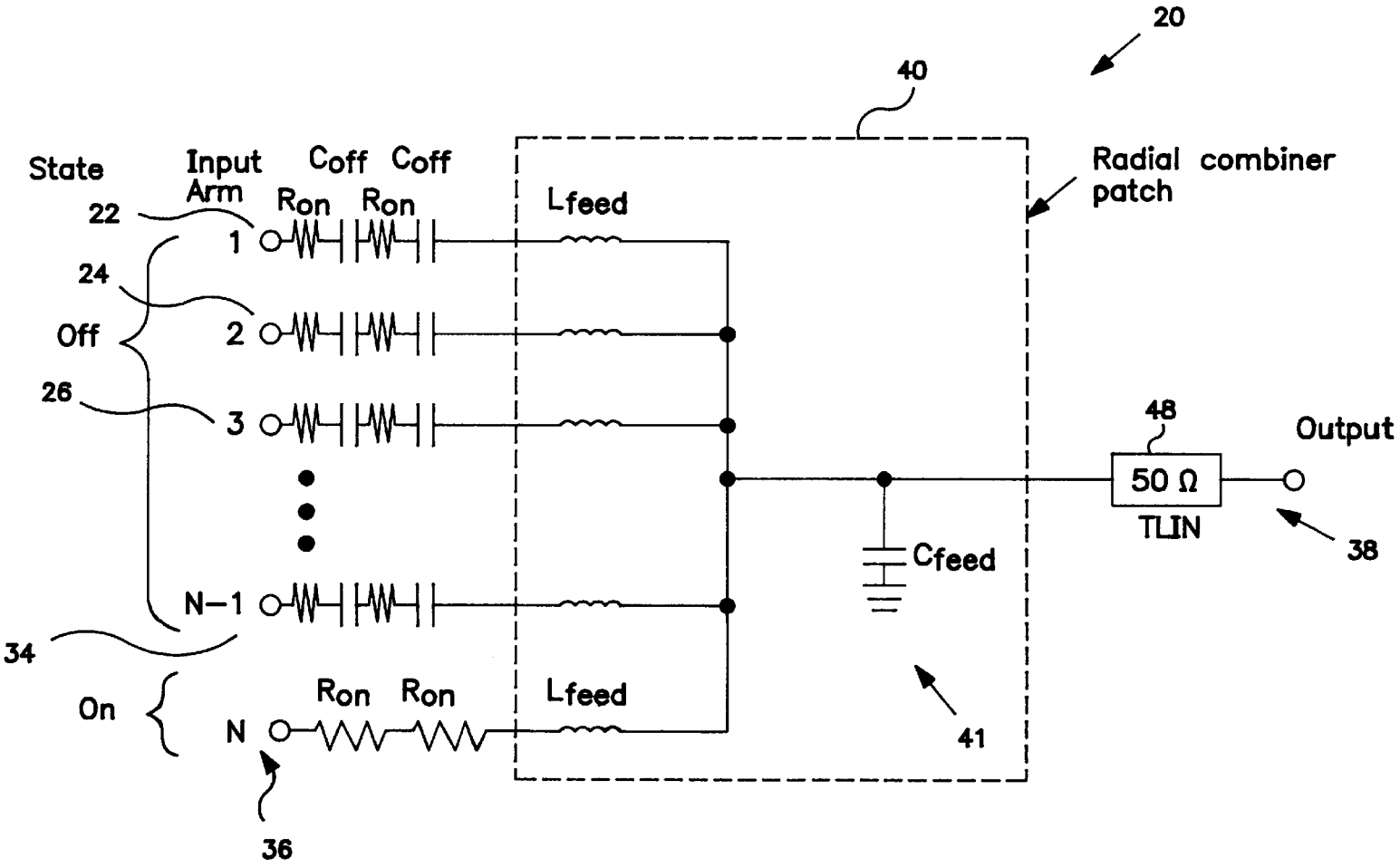
FIG. 3 is a schematic diagram of an equivalent circuit for N-way radially combined microstrip switch wherein the radially combined patch is represented as an L-C low pass network.
Figure 4:
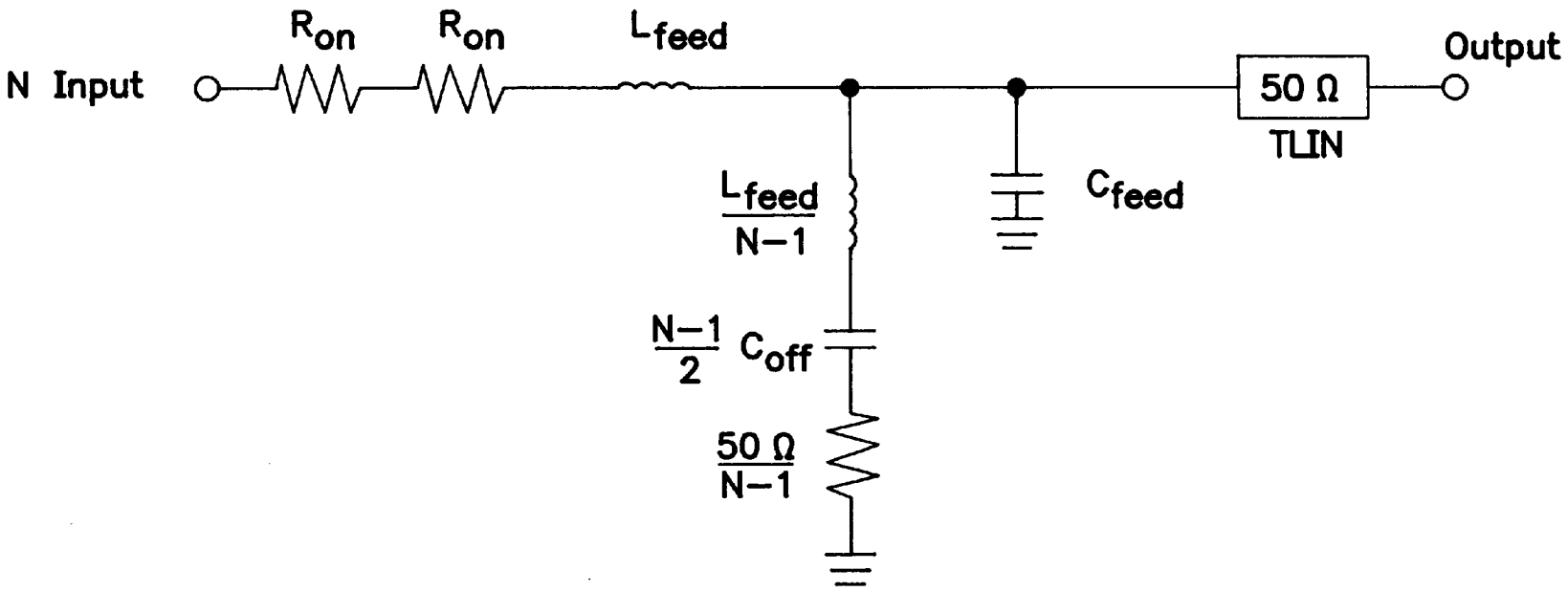
FIG. 4 is a schematic diagram of an equivalent circuit of the thru-path of the Nth arm for an N-way radially combined microstrip switch.
Figures 5A, 5B:
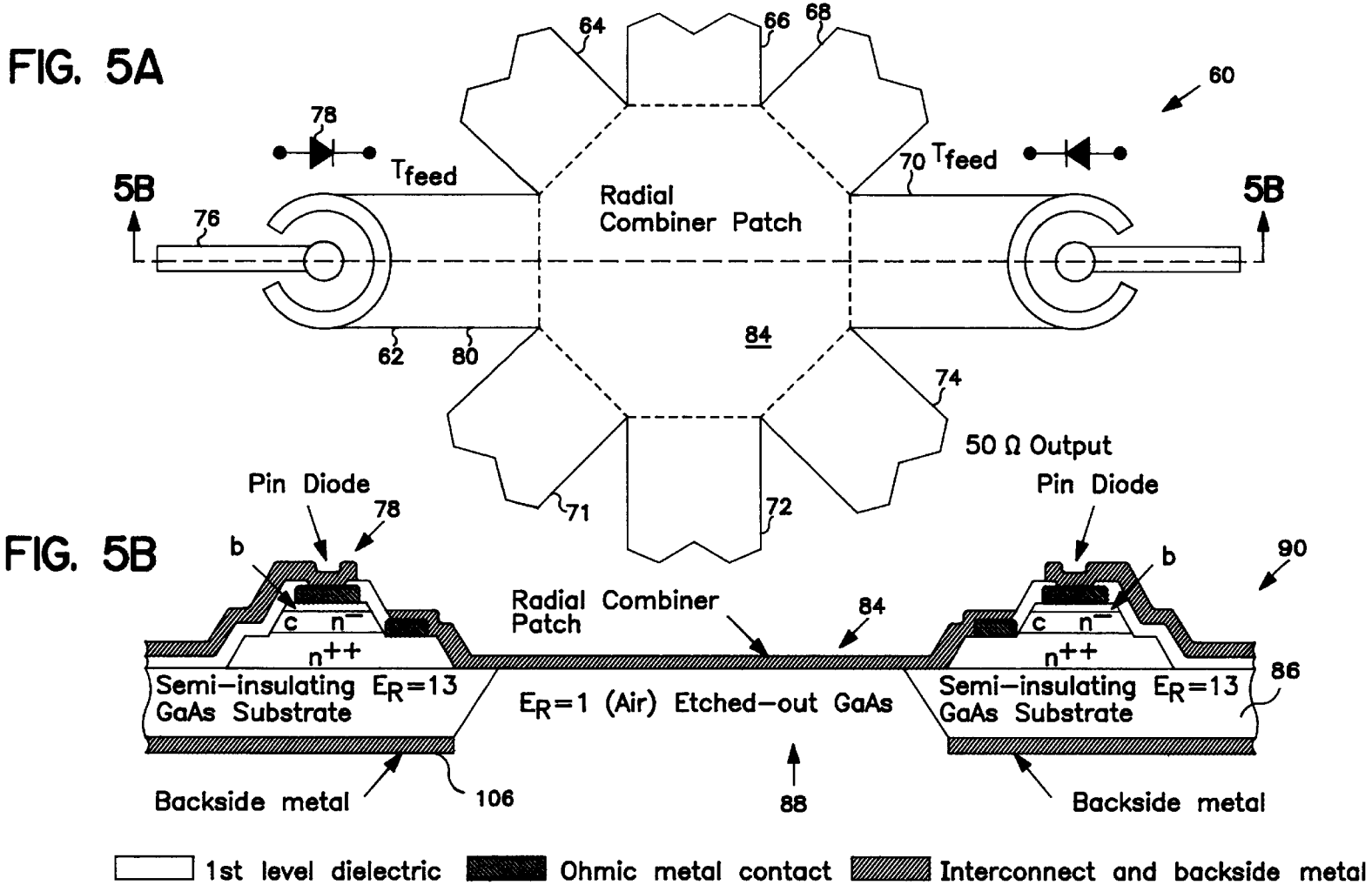
FIG. 5*a* is a planar diagram of a radially combined microstrip switch in accordance with the present invention.
FIG. 5*b* is a cross section diagram of the radially combined microstrip switch illustrated in FIG. 5*a*.

FIG. 5*a* illustrates a planar view of an N-way radially combined single pole N-throw microstrip switch 60 in accordance with the present invention. The microstrip switch 60 includes N input switch arms 62, 64, 66, 68, 70, 71, and 72 and an output arm 74 which defines an output port. As will be appreciated by those of ordinary skill in the art, although FIG. 5*a* illustrates 7 input switch arms 62–72 and a single output port 74, it is clear that the principles of the present invention are applicable to virtually any number of input arms. Each of the input switch arms 62–72 includes an input microstrip transmission line 76, for example 50 Ω, one or more serially coupled p-i-n diodes 78 and an interconnecting microstrip transmission line 80. Each of the interconnecting microstrip transmission lines 80 are radially connected to a patch 84. The output arm 74, for example, a 50 Ω microstrip transmission line, is also connected to the radially combined patch 84. In order to reduce the shunt capacitance of the switch 60 and thus the insertion loss of the microstrip switch 60 at millimeter wave frequencies, the radially combined patch 84 is air suspended as better illustrated in FIG. 5*b*.

Referring to FIG. 5*b*, the radially combined single pole N-throw microstrip switch 60 in accordance with the present invention may be formed on a suitable type III-V substrate 86, such as a GaAs substrate. An important aspect of the invention relates to the cavity 88 under the radially combined patch 84. As discussed above, by air suspending the radially combined patch, the shunt capacitance and thus the insertion loss of the switch 60 is greatly reduced at millimeter wave frequencies. A top side 90 of the substrate 86 is processed by conventional processing techniques to form the top side 90 structure illustrated in FIG. 5*b*. After the conventional top side processing of the microstrip switch is completed, the wafer may be flip mounted for fabricating the radial cavity as illustrated in FIGS. 6*a*–6*i*.

Figure 6A:
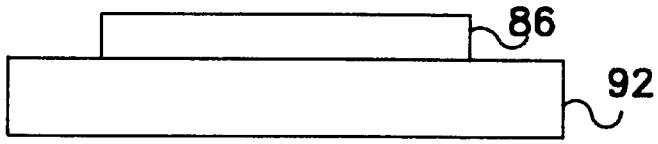
FIGS. 6*a*–6*i* illustrate the processing steps for fabricating a portion of the radially combined microstrip switch in accordance with the present invention.
Figure 6B:
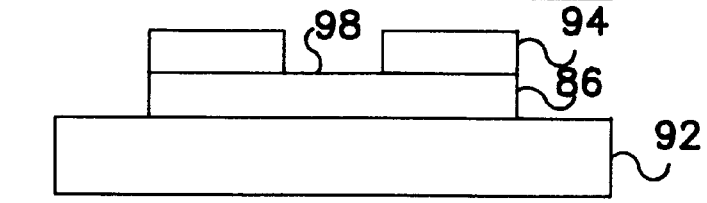
Figure 6C:
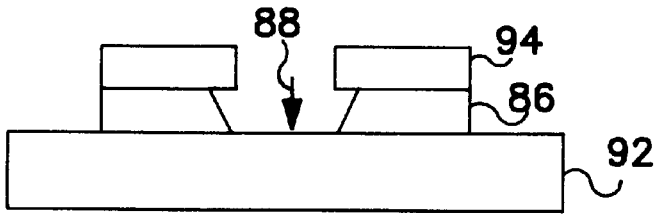
Figure 6D:
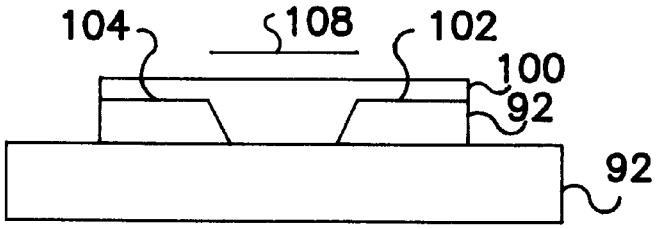
Figure 6E:
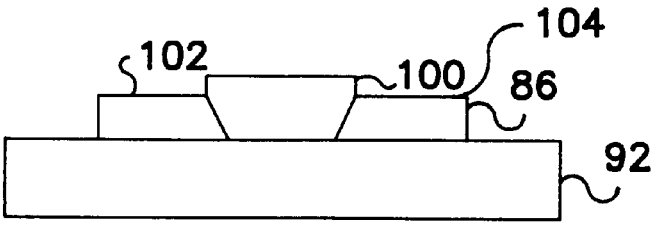
Figure 6F:
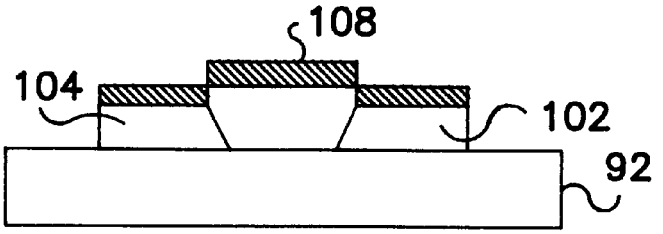
Figure 6G:
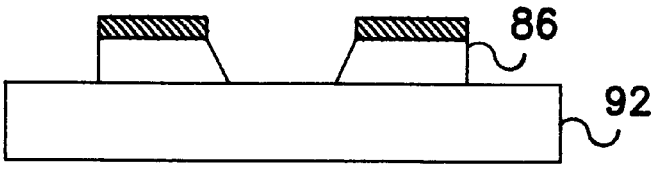

FIGS. 6*a*–6*i* illustrate the processing steps for fabricating the cavity 88 in the substrate 86. As will be apparent to those of ordinary skill in the art, the processing steps are compatible with conventional MMIC processing technology. Referring to FIG. 6*a*, the substrate 86 is mounted frontside down onto a supporting mechanical wafer 92, such as a silicon wafer. After the substrate 86 is secured to the supporting mechanical wafer 92, a photoresist 94 is spun on top of the substrate 86. As shown in FIG. 6*b*, photomask 96 is used to mask off the region for the cavity 88. The photoresist 94 is exposed by way of the mask 96 and developed to expose an area 98 of the substrate 86 which will be removed to form the cavity 88. Subsequently, as illustrated in 6*c*, the cavity 88 may be formed by etching, for example, reactive ion etching (RIE), completely through the substrate 86 in order to form the cavity 88. Once the cavity 88 has been formed, a planarizing photoresist 100, such as AZ 9620, to cover the exposed portions of 102 and 104 of the substrate 86 as well as the cavity 88. As shown in FIG. 5*b*, a backside metal 106 is deposited beneath the substrate 86. Prior to depositing the backside metal 106, a second mask 108 (FIG. 6*d*) is used to define the regions for the backside metal 106. The planarizing photoresist 102 is exposed by way of the mask 108 and developed to form the structure illustrated in FIG. 6*e*. Subsequently, in step 6*f* the backside metal, for example, Ti—Au, is deposited onto the exposed areas 102 and 104 of the substrate 86 as well as on top of the planarizing photoresist 100. The backside metal 106 as well as the metallization 108 covering the cavity 88 is developed by conventional liftoff techniques by developing the planarizing photoresist 100 which removes the metal 108 from the cavity 108 as generally shown in FIG. 6*g*. This metallization forms the backside metal plane of the microstrip transmission media. Vias from the top side to backside ground are formed from the selective metal evaporation process mentioned above.

Figure 7:
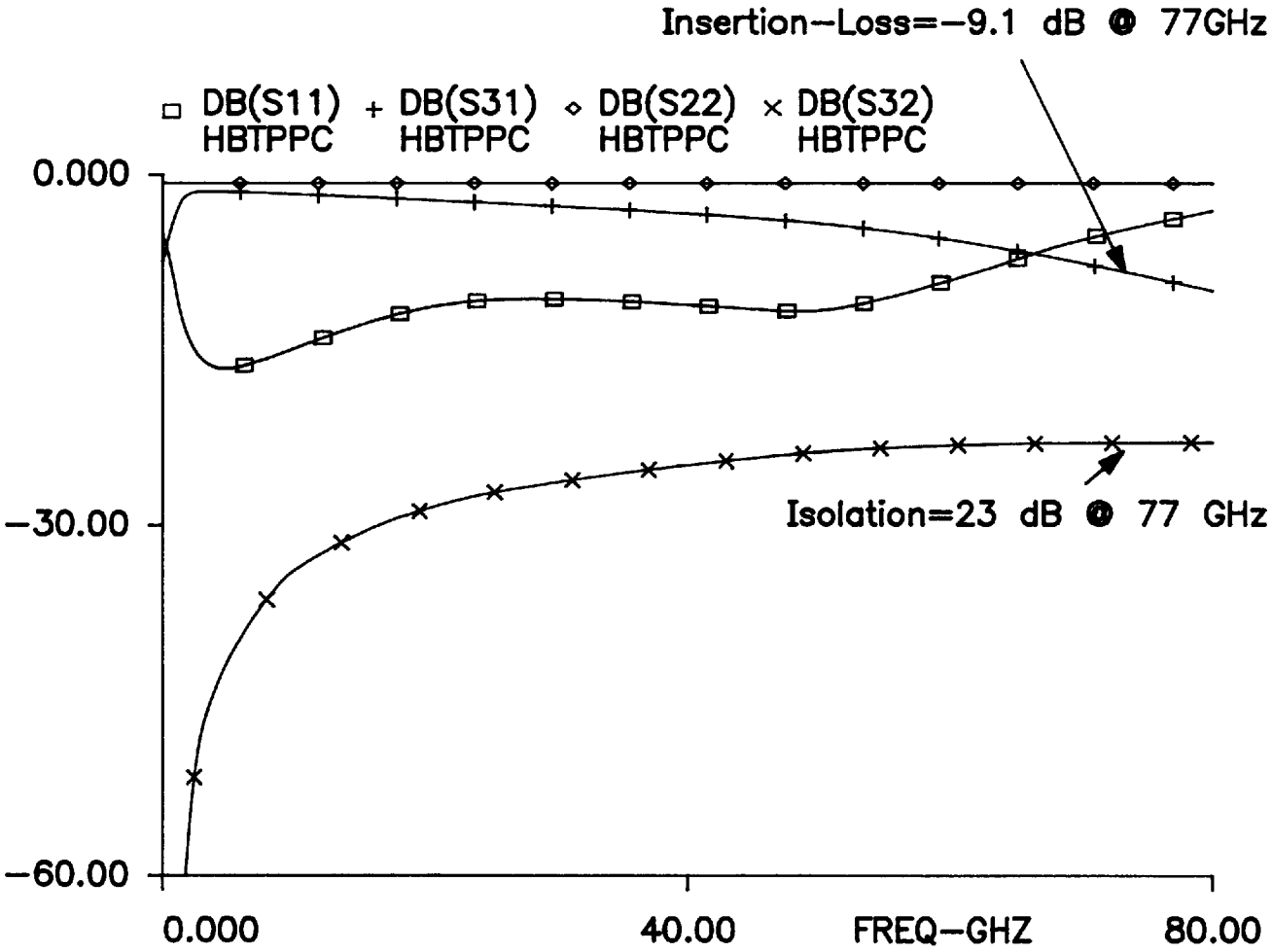
FIG. 7 is a graphical illustration of the insertion loss, return loss and isolation performance loss as a function of frequency in GHz for a conventional single pole diode microstrip switch.
Figure 8:
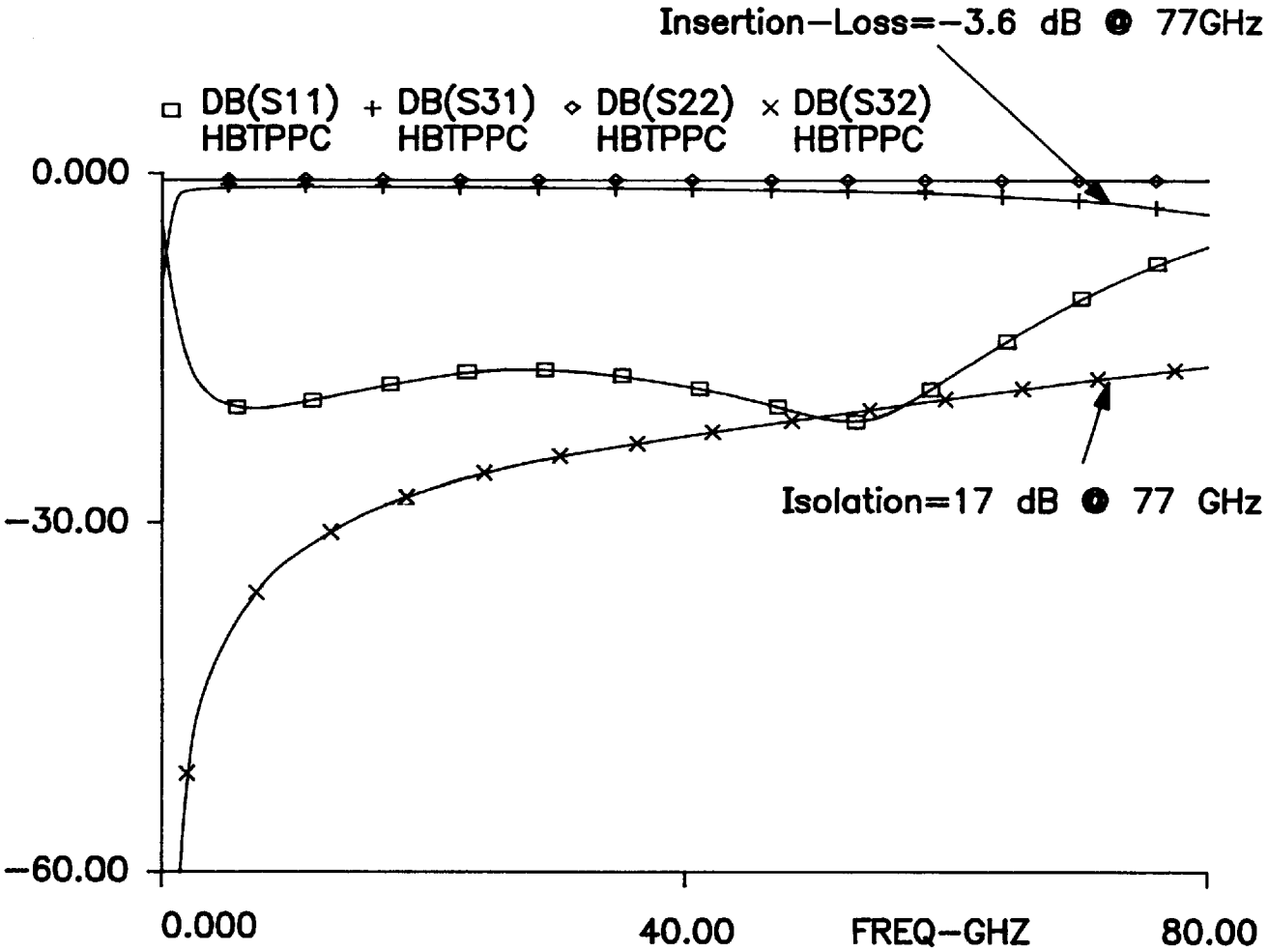
FIG. 8 is similar to FIG. 7 illustrating the insertion loss, return loss and isolation performance the radial combined switch in accordance with the present invention.

FIGS. 7 and 8 illustrate the insertion loss, return loss and isolation performance of a single pole 8 throw (SP8T) p-i-n diode microstrip switch fabricated utilizing a conventional construction and a microstrip switch fabricated in accordance with the present invention, respectively. As shown at 77 GHz, the conventional microswitch radially combined microstrip switch achieves −9.1 dB insertion loss, 5 dB return loss and 23 dB isolation. In comparison, the radially combined microstrip switch, fabricated in accordance with the present invention, achieves an air insertion loss of 3.6 dB, 10 dB return loss and about 17 dB isolation. As such, it should be clear that the microswitch in accordance with the present invention proves the insertion loss by as much as 5.5 dB at 77 GHz.

Figure 9:
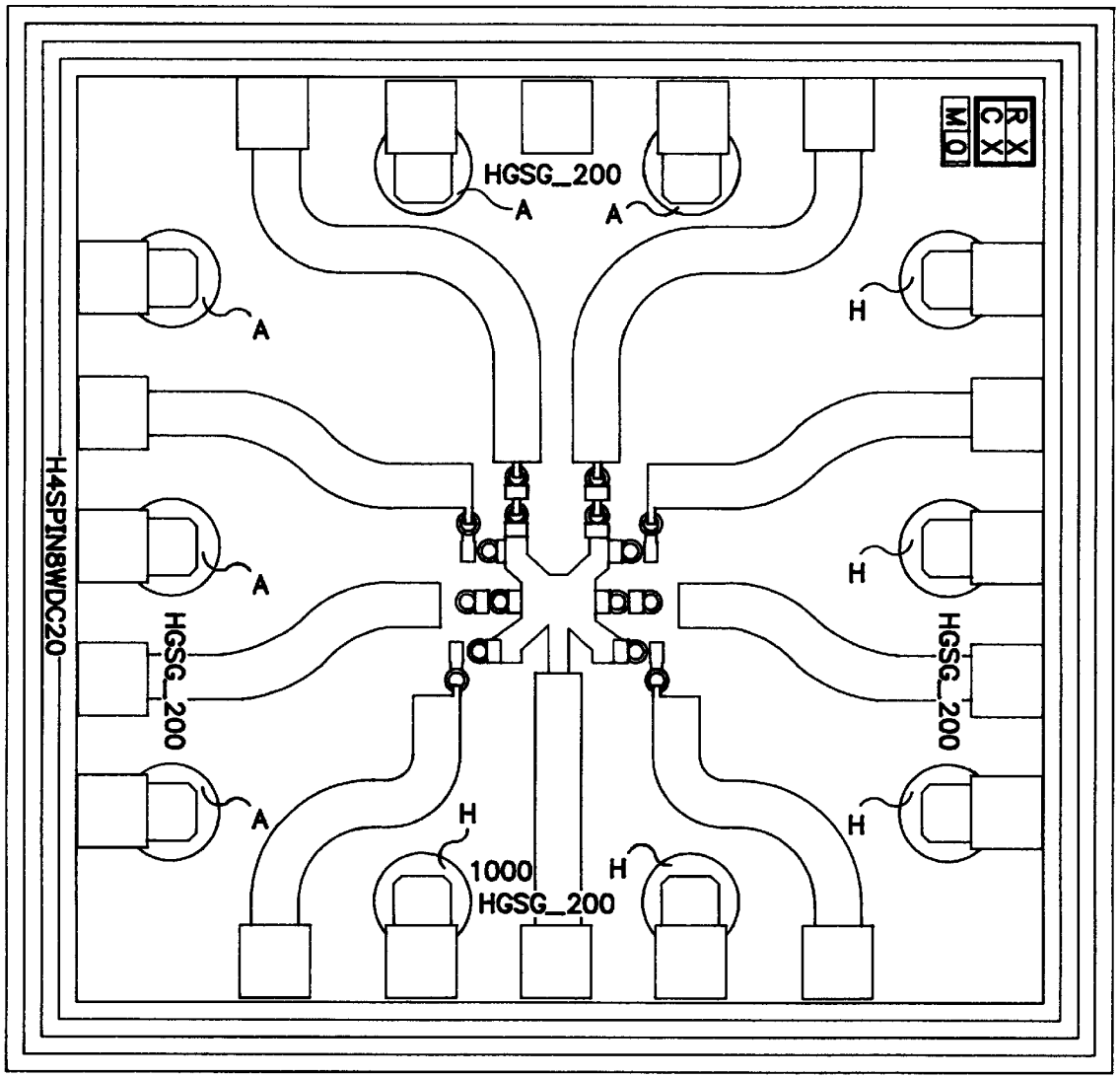
FIG. 9 is a planar view layout of a typical single pole eight throw microstrip switch.

FIG. 9 illustrates a typical layout of SP8T radially combined p-i-n diode microswitch illustrating the physical size constraints of the radial topology. As shown, there is limit to how small the area of the radial patch can be laid out due to the physical size constraint of the radial combined patch which is governed by the size and number of switch arms. Also, the electrical performance constrains how small the center combiner can be since the arm isolation and 50 Ω output patch will degrade with small combiner patch geometry.

Figure 6H:
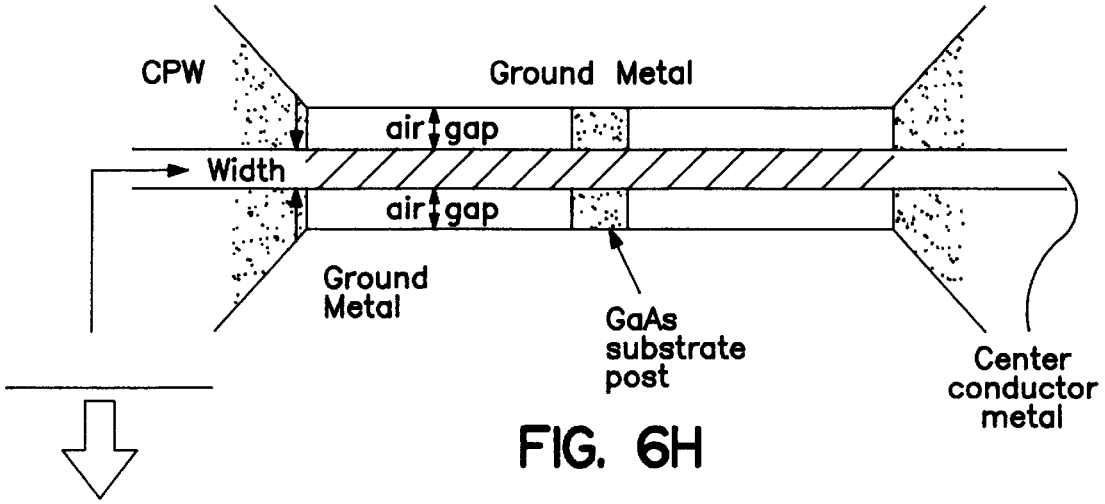
Figure 6I:
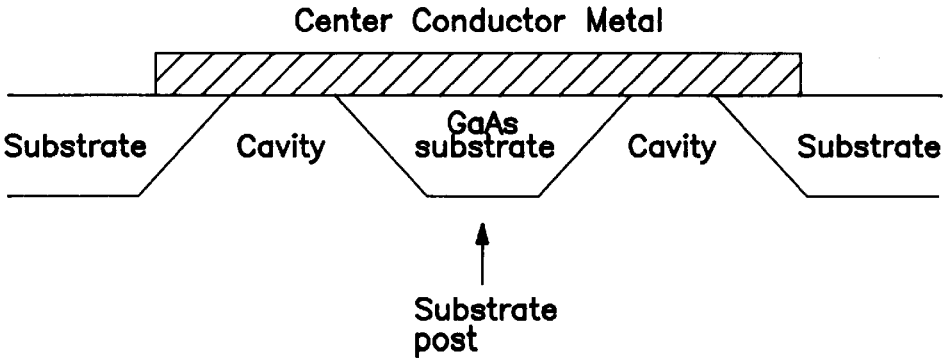

As will be appreciated by those of ordinary skill in the art, the principles of the present invention are also applicable to coplanar wave guides, for example as disclosed in "*Micromachined Coplanar Waveguides in CMOS Technology*" by V. Milanovic, M. Gaitan, E. Bowan and M. Zaghloul, iie. *Microwave and Guided Wave Letters,* Vol. 6, No. 10, October, 1996, pp. 380–382, hereby incorporated by reference. As disclosed therein, a coplanar waveguide formed from CMOS Technology is formed with a V-shaped cavity beneath a microstrip structure. The V-shaped cavity is formed by rather complicated etching process which includes both isotropic etching and anastropic etching. The principles of the present invention are adapted to be applied to the coplanar waveguide in order to provide a relatively simplified process for forming the cavity under the microstrip. More particularly, the process in accordance with the present invention described above may be used to fabricate a coplanar wave guide. However, parts of the center majority conductor may be suspended while leaving parts of the substrate for mechanical support. A top and cross-sectional drawing of such a CPW structure is represented in FIGS. 6*h* and 6*i*.

Obviously, many modifications and variations of the present invention are possible in light of the above teachings. Thus, it is to be understood that, within the scope of the appended claims, the invention may be practiced otherwise than as specifically described above.

What is claimed and desired to be covered by a Letters Patent is as follows:

We claim:

1. A radially combined microstrip switch configured as a single pole N throw switch, the switch comprising:

a generally planar substrate;

N input switch arms for receiving N input signals, each input switch arm including a microstrip transmission line and a serially coupled first p-i-n diode;

an output switch arm;

said input and output switch arms formed generally parallel to the plane of said substrate; and a radially combined conductive patch for selectively coupling said N input switch arms to said output switch arm, said radially combined patch formed generally parallel to the plane of said substrate and formed with an air cavity therebeneath for reducing the shunt capacitance of the switch.

2. The radial microstrip switch as recited in claim 1, wherein one or more of said N input switch arms includes a second p-i-n diode, serially connected to said first p-i-n diode.

3. The radial microstrip as recited in claim 2, wherein one or more of said input switch arms includes an input microstrip transmission line, serially coupled to one end of said serially connected first and second p-i-n diodes forming input ports.

4. The radial microstrip as recited in claim 3, wherein one or more of said input switch arms includes an interconnecting microstrip transmission line, coupled between an opposing end of said serially connected first and second p-i-n diodes and said radially combined patch.

5. The radial microstrip as recited in claim 4, wherein said output port is formed from a microstrip transmission line connected to said radially combined patch.

6. A microstrip switch comprising:

a generally planar substrate;

a plurality of input switch arms formed on said substrate, each input switch arm including a microstrip transmission line and a serially coupled p-i-n diode;

an output port formed on said substrate;

a conductive patch electrically coupled to said plurality of input arms and said output port, said conductive patch being generally parallel to the plane of said substrate and said input switch arms and said output port; and an air cavity, formed under said patch.

* * * * *